US005244363A

United States Patent [19]

Olson

[11] Patent Number: 5,244,363

[45] Date of Patent: Sep. 14, 1993

[54] LOW BLOW-BY COMPRESSOR

[75] Inventor: Robert J. Olson, Santa Rosa, Calif.

[73] Assignee: Prolong Systems, Inc., Wilsonville, Oreg.

[21] Appl. No.: 880,572

[22] Filed: May 8, 1992

[51] Int. Cl.[5] ..... F04B 39/10

[52] U.S. Cl. ..... 417/490; 417/571; 92/162 R

[58] Field of Search ..... 277/235 B; 91/408; 92/162 R, 162 P, 85 B; 417/490, 560, 569, 571

[56] References Cited

U.S. PATENT DOCUMENTS

| | | | |
|---|---|---|---|
| 1,819,643 | 8/1931 | Fleisher . | |
| 1,856,078 | 5/1932 | Leonard | 417/490 |
| 2,617,275 | 11/1952 | Goff et al. | 62/175.5 |
| 3,102,777 | 9/1963 | Bedrosian et al. | 99/154 |
| 3,360,380 | 12/1967 | Bedrosian | 99/154 |
| 3,445,194 | 5/1969 | Thomas et al. | 23/281 |
| 3,508,881 | 4/1970 | Hagenauer et al. | 23/281 |
| 3,536,370 | 10/1970 | Evans et al. | 312/1 |
| 3,547,576 | 12/1970 | Sheikh | 21/53 |
| 4,212,891 | 7/1980 | Fujita et al. | 426/231 |
| 4,228,197 | 10/1980 | Means | 426/419 |
| 4,480,844 | 11/1984 | Kozerski | 277/235 B |
| 4,516,784 | 5/1985 | Merz | 277/235 B |
| 4,691,928 | 9/1987 | Abele | 277/235 B |
| 4,817,391 | 4/1989 | Roe et al. | 62/17 |
| 4,880,441 | 1/1989 | Kesting et al. | 56/16 |
| 5,025,828 | 6/1992 | Lin | 417/571 |

FOREIGN PATENT DOCUMENTS

28492/30 8/1930 Australia .

*Primary Examiner*—Richard A. Bertsch
*Assistant Examiner*—Charles C. Freay
*Attorney, Agent, or Firm*—Stetina & Brunda

[57] ABSTRACT

A low blow-by compressor has a piston with at least one first ring disposed at the top end thereof and at least one second ring disposed at the bottom end thereof. A port is formed in the cylinder such that the port is above the second rings when the piston is positioned at top dead center and the port is below the first rings when the piston is positioned at bottom dead center such that fluid which blows by the first rings tends to exit the cylinder through the port rather than to blow-by the second rings. Thus any fluid which blows by the first rings can either be exhausted or recycled through the compressor inlet. The compressor utilizes reed valves wherein a first valve plate is attached to the cylinder and a second valve plate is disposed in laminar juxtaposition to the first valve plate. A reed valve gasket assembly is disposed intermediate the first and second plates and an o-ring is disposed about the periphery of the valve reed gasket assembly to prevent fluid leakage therethrough. Thus, the low blow-by compressor may be utilized in environments where leakage of the compressed fluid is undesirable.

6 Claims, 2 Drawing Sheets

Fig. 6
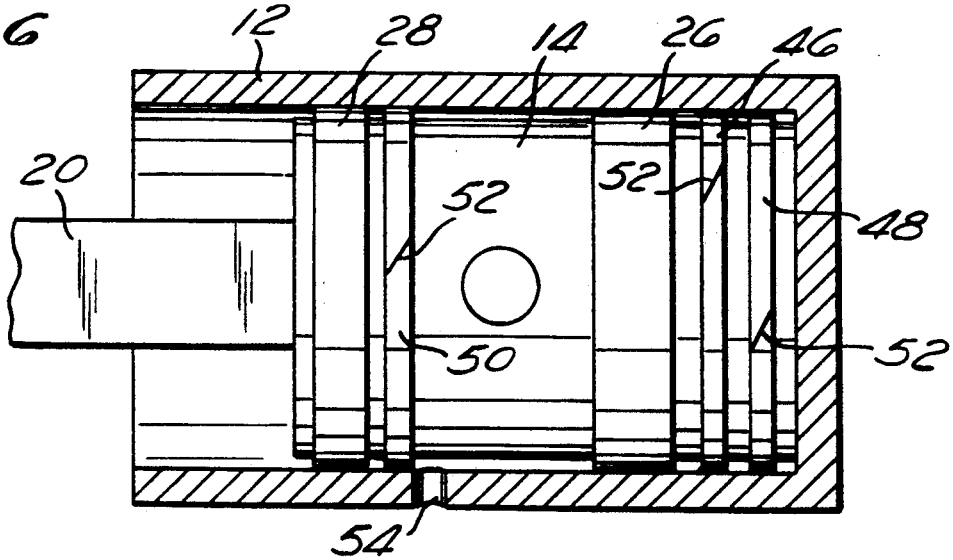
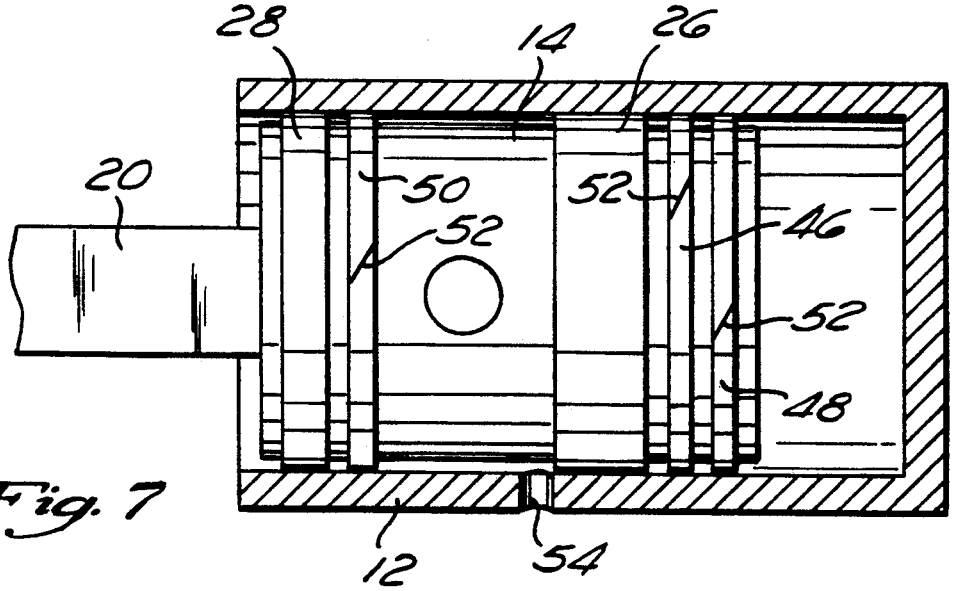
Fig. 7

LOW BLOW-BY COMPRESSOR

FIELD OF THE INVENTION

The present invention relates generally to fluid pumps and more particularly to a low blow-by oilless compressor wherein the quantity of fluid leaking therefrom is minimized.

The system is adapted to be utilized in conjunction with transport containers, though it will be recognized that the system may also be utilized in conjunction with other types of transport container vessels.

The system generally comprises a first inlet which is adapted to receive ambient air from outside the transport container. Fluidly connected to the first inlet is an oilless air compressor having a compressor exhaust port. The air compressor is powered by a small diesel engine which drives the compressor as well as a 12-VDC alternator. The air compressor for containers has a directly coupled electric motor. The compressor is preferably belt-driven, though it may alternatively be coupled directly to the engine bell housing. The 12-VDC alternator is also belt-driven from the engine crank shaft. The alternator charges a 12-volt battery and supplies power to a controller assembly, as will be discussed below.

Fresh air is drawn into the first inlet and into an air filter disposed therein by the compressor where particulates are removed down to a size of 10.0 or less microns. Thereafter, the filtered air enters the compressor and is compressed to 80–125 psig. The compressed air is then cooled through a finned tubing heat exchanger connected to the exhaust port of the compressor and subsequently enters a receiving tank. The compressed air is then filtered to 0.3 microns by second and third filters connected to the outlet of the receiving tank. A drain solenoid interfaced to the receiving tank and second and third filters is periodically actuated by the controller assembly to remove water condensates.

After passing through the second and third filters, the compressed air passes through a relieving regulator which prevents the compressed air pressure from exceeding a 125-psig maximum compressor rating. Additionally, a 150-psig high-pressure safety relief valve prevents an over-pressurization situation from occurring. The compressed air then passes through and is heated by an electric air heater to approximately 30 degrees to 50 degrees C. A thermistor senses the air temperature and relays the signal to the controller assembly, while a high-temperature safety switch prevents overheating in the event of a thermistor failure.

The heated, filtered, compress®d air then enters a gas-separation means via an entrance port and flows therethrough. The compressed air enters the bore of hollow fibers, i.e. membranes, within the gas-separation means where fast gases, such as $O_2$, $CO_2$, and $H_2O$ permeate through the walls of the fibers at a faster rate than slow gases, such as $N_2$. The rate at which the air passes through the membranes determines the volume and purity of the $N_2$ produced. After exiting the gas-separation means via an exit port, the gas passes into a first outlet fluidly connected to the exit port which is used to place the exit port in fluid communication with the interior of the transport container. Disposed within the first outlet is an adjustable needle valve which controls the $N_2$ flow rate and purity. In the preferred embodiment, the $N_2$ is pumped into the rail oar through the unloading manifolds at the bottom of the car. Importantly, a continual stream of $N_2$ is added to eventually lower the $O_2$ level within the rail car to 5% or less. The system continues to generate $N_2$ for 2 to 10 days to insure that all insects, larvae, and eggs within the products being transported are effectively killed. The $N_2$ is piped into the transport container until the desired $O_2$ levels are achieved.

An optional $CO_2$ supply can also be used in conjunction with the nitrogen generation system to speed up the kill rate, thereby increasing the effectiveness of the present system. The $CO_2$ supply system preferably comprises a $CO_2$ supply source fluidly connected to the first outlet via a $CO_2$ valve connected therein. The $CO_2$ valve is movable between open and closed positions with the $CO_2$ supply source being operable to introduce $CO_2$ into the rail car via the first outlet when the $CO_2$ valve is actuated to the open position by the controller assembly. The $CO_2$ source preferably comprises a liquid $CO_2$ cylinder, though dry ice enclosed in an insulated container may be utilized as an alternative.

The system further comprises a second outlet fluidly connected to the transport container for receiving gas from therewithin. Connected to the second outlet is a gas-analyzing means for monitoring and recording the $O_2+CO_2$ levels of gas within transport container within the rail car. The gas-analyzing means may further be adapted to monitor and record the carbon dioxide levels of the gas within the rail car in the event a $CO_2$ supply is utilized in conjunction with the present system. The gas-analyzer means is disposed within the controller assembly to which the second outlet is connected with the controller assembly being adapted to selectively draw gas from within the transport carrier into the gas-analyzer means.

The controller assembly comprises a housing having a programmable microprocessor and a data storage means disposed therein, both of which are electrically powered by the alternator. The housing further includes a display device which is also powered by the alternator. Disposed within the housing and electrically interfaced to the microprocessor is a control valve which is selectively actuatable between first and second positions, the second outlet being fluidly connected to the control valve. Also disposed within the housing and electrically interfaced to the microprocessor is a pump which is fluidly connected between the control valve and the gas-analyzer means. Activation of the pump concurrently with the actuation of the control valve to the first position by the microprocessor draws gas from within the transport container into the gas-analyzer means so that the gas-analyzer means may transmit oxygen and/or carbon dioxide level measurements of the gas to the data storage means and to the display device. The gas-analyzer means preferably comprises an oxygen sensor and a carbon dioxide sensor, both of which are fluidly connected to the pump. As previously specified, the oxygen and carbon dioxide sensors are preferably disposed within the controller housing, though they may alternatively be disposed within the transport container.

The system further comprises a first passage which fluidly connects the first outlet to the control valve. The control valve is operable to place the first outlet in fluid communication with the gas-analyzer means via the first passage while simultaneously blocking the communication between the second outlet and the gas-analyzer means when actuated to the second position by the microprocessor. This manner of operation allows the gas-analyzer means to monitor the oxygen and carbon dioxide levels of gas exiting the gas-separation means during system start-up. The control valve is further operable to block the communication between the first passage and the gas-analyzer means when actuated to the first position.

The controller assembly includes an air-calibration means for calibrating the gas-analyzer means by passing ambient air therethrough when activated by the microprocessor. The air-calibration means preferably comprises an air-calibration valve electrically interfaced to the microprocessor and disposed within the housing between the control valve and the pump which is movable between first and second position.s The air-calibration means further includes a fresh air inlet which is connected to the air-calibration valve. The air-calibration valve is operable to place the control valve in fluid communication with the gas-analyzer means while simultaneously blocking the fresh-air inlet when actuated to the first position by the microprocessor, and place the fresh-air inlet in fluid communication with the gas-analyzer means while simultaneously blocking the communication between the control valve and the gas-analyzer means when actuated to the second position by the microprocessor.

In addition or as an alternative to the air-calibration means, the controller assembly may also include a gas-calibration means for calibrating the gas-analyzer means by passing a pre-selected calibrating gas therethrough when activated by the microprocessor. The gas-calibration means preferably comprises a gas-calibration valve electrically interfaced to the microprocessor and disposed within the housing between a calibrating gas source and the gas-analyzer means. The gas-calibration valve is movable between open and closed positions and is operable to place the calibrating gas source in fluid communication with the gas-analyzer means when actuated to the open position by the microprocessor. When the gas-calibration valve is actuated to the open position by the microprocessor, the microprocessor further acts to actuate the control valve to the first position, the air-calibration valve to the second position, and deactivate the pump.

As discussed in U.S. Ser. No. 07/686,174, filed Apr. 16, 1991, and entitled "Controlled Atmosphere Storage Container" and U.S. Ser. No. 07/843,545, filed Feb. 28, 1992, and entitled "Controlled Atmosphere Storage System", the contents of both of which are hereby incorporated by reference, it is desirable to dispose the compressor within the storage container. This both maintains the compressor's operating temperature within a desired range and isolates the compressor from environmental contamination, i.e. rain, salt water (for ocean going vessels), dirt, etc. The operating temperature of the compressor is controlled by disposing it within a container having a controlled temperature and also by positioning it within the container such that it is exposed to the circulating air flow of the container. As such, it is highly desirable to dispose the compressor within the container whose environment is being controlled thereby.

However, contemporary compressors exhibit a tendency to leak the gas being compressed from the cylinder thereof into the compressor's environment. Such leakage is known as blow-by and is detrimental to any attempt to obtain a controlled atmosphere within the storage area. This is because the gas being compressed is air, which contains approximately 21% oxygen, and is therefore not desired within the compressor's environment or storage container. That is, by leaking air having a normal concentration of oxygen into the storage container, the effect of the atmosphere control system is diminished. This occurs because the concentration of oxygen in normal air (21%) is higher than that of the processed air (less than 5%) as supplied by the system. Leakage therefore increases the oxygen content of the air within the storage container.

Leakage commonly occurs on contemporary oilless compressors at two points. First, blow-by occurs when compressed gas leaks past the piston rings on the compression or upstroke of the piston. Second, compressed gas leaks through the porous reed valve gasket during the compression stroke.

Blow-by occurs as pressure increases within the cylinder during the upstroke of the piston and pressurized gas escapes downwardly over the piston rings and through the gap formed at the ends of the piston rings. When utilizing an open crankcase oilless compressor, blow-by gas escapes directly into the compressor's immediate environment.

As the piston approaches top dead center and pressure increases within the cylinder, gas is forced through the porous material of the reed valve gasket and thus escapes from between the two valve plates of the reed valve assembly. This gas is exhausted directly into the immediate environment of the compressor.

As such, it is desirable to provide a compressor which does not contribute substantially to the oxygen concentration within the storage container, and more particularly which does not experience substantial blow-by or leakage through the reed valve gasket.

SUMMARY OF THE INVENTION

The present invention specifically addresses and alleviates the above mentioned deficiencies associated in the prior art. More particularly, the present invention comprises a low blow-by compressor and has a piston with at least one first ring disposed at the top end thereof and at least one second ring disposed at the bottom end thereof. A port is formed in the cylinder such that the port is above the second rings when the piston is positioned at top dead center and the port is below the first rings when the piston is positioned at bottom dead center such that fluid which blows by the first rings exits the cylinder through the port rather than blowing by the second rings. Thus any fluid which blows by the first rings can either be exhausted or recycled through the compressor inlet.

More particularly, fluid which blows by the upper rings is captured intermediate the upper and lower rings and is communicated through the port formed in the cylinder to either outside the container or to the compressor inlet to be recompressed.

The compressor utilizes reed valves wherein a first valve plate is attached to the cylinder and a second valve plate is disposed in laminar juxtaposition to the first valve plate. A reed valve gasket assembly is disposed intermediate the first and second valve plates and an o-ring, preferably comprised of a high-temperature polymer, such as silicone rubber or RTV, is disposed about the periphery of the valve reed gasket assembly to prevent fluid leakage therethrough. Additionally, the piston rings are bias cut to eliminate the ring end gap and thereby significantly reduce blow-by. Thus, blow-by and leakage are substantially eliminated and the compressor may thus be utilized in an environment which is intolerant to the fluid being compressed.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 6 is a cross-sectional side view of a piston and cylinder according to the present invention showing the bias cut rings and port formed in the cylinder wall, depicting the piston at top dead center; and FIG. 7 is a cross-sectional side view of the piston and cylinder of FIG. 6 depicting the piston at bottom dead center.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
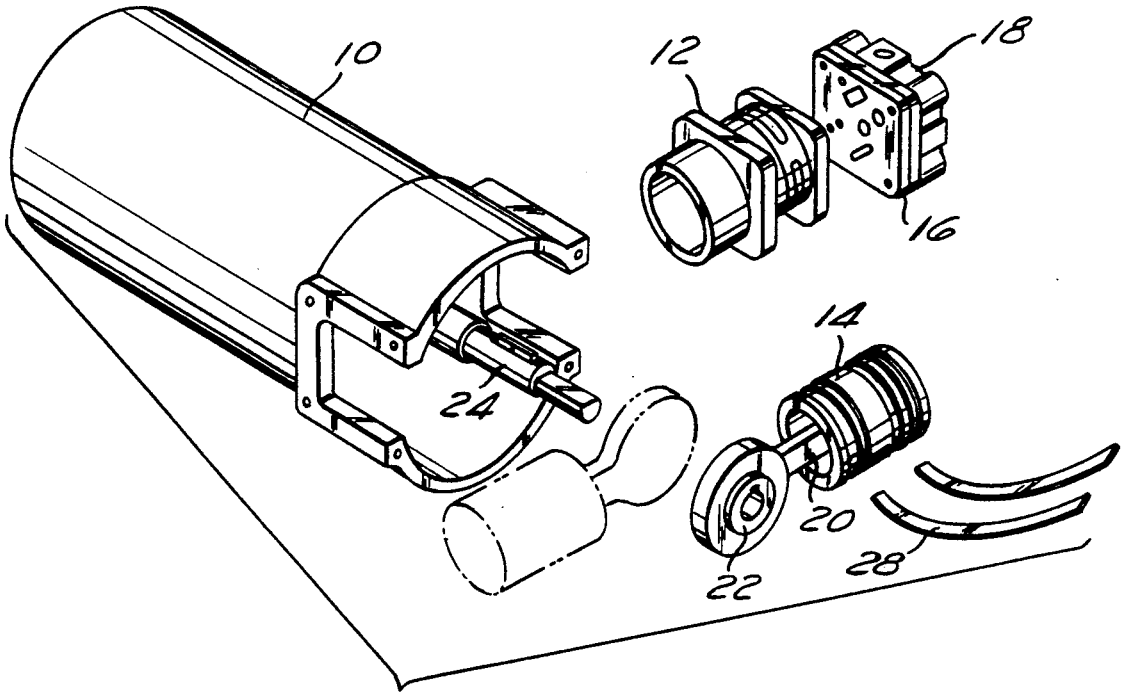
FIG. 1 is an exploded perspective view of the low blow-by compressor of the present invention.
Figure 2:
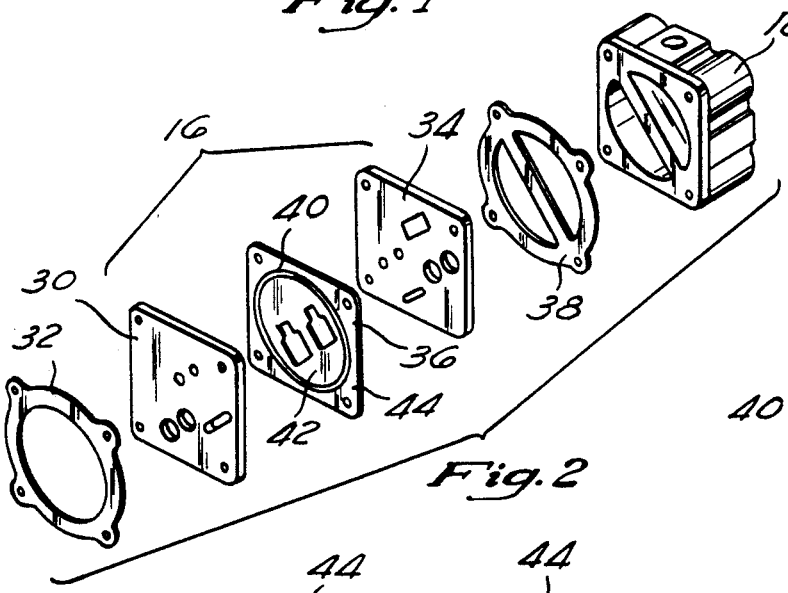
FIG. 2 is an exploded perspective view of the reed valve assembly and head showing the first and second valve plates and reed valve gasket.
Figure 3:
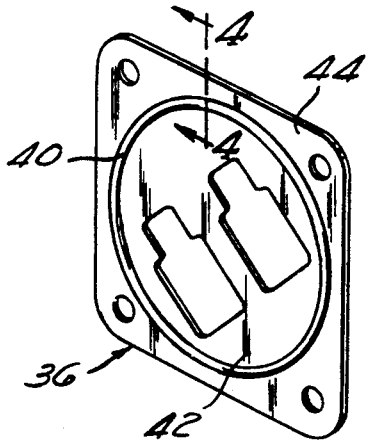
FIG. 3 is an enlarged perspective view of the reed valve gasket of FIG. 2.

The low blow-by oilless compressor of the present invention is illustrated in FIGS. 1-7 which depict a presently preferred embodiment of the invention. Referring now to FIG. 1, the low blow-by compressor is comprised generally of a motor 10, at least one cylinder 12, a piston 14 disposed within each cylinder 12, a reed valve assembly 16, and a cylinder head 18. As with contemporary compressors, the piston is driven via a connecting rod 20 having an eccentrically mounted sealed bearing 22 disposed at the lower end thereof and positioned upon keyed shaft 24 of motor 10. Upper 26 and lower 28 TEFLON (a registered trademark of DuPont de Nemours, Inc.) piston skirts encircle each piston 14 to reduce friction and guide each piston within the cylinder between the piston 14 and the cylinder 12 as in contemporary oilless compressors.

Referring now to FIGS. 2-5, the reed valve assembly comprises a first valve plate 30 which attaches to the outboard or upper-most end of the cylinder 12, having gasket 32 positioned therebetween; and second valve plate 34 which attaches to the first valve plate 30, having the reed valve gasket 36 positioned therebetween. Cylinder head 18 attaches to the second valve plate 34, having gasket 38 positioned therebetween.

An o-ring 40 is disposed about the periphery of the reed valve gasket 36. The o-ring 40 is preferably adhesively bonded to separate inner 42 and outer 44 portions of the reed valve gasket 36 such that it interconnects the inner 42 and outer 44 portions thereof. That is, the reed valve gasket 36 is formed as two separate pieces, i.e. the inner portion 42 and the outer portion 44 and the o-ring 40 is adhesively bonded or glued to the two separate pieces such that a single, generally planar, reed valve gasket 36 is formed thereby.

Alternatively, the reed valve gasket may be formed as two separate pieces, i.e. the inner portion 42 and the outer portion 44, which are attached intermediate the valve plates 30 and 34 by adhesively bonding the two separate portions 42 and 44 thereto and then placing the o-ring 40 intermediate the two separate pieces 42 and 44 and optionally adhesively bonding the o-ring in place. As a further alternative, the o-ring 40 may be disposed within a groove formed upon a single, integral reed valve gasket comprising both the inner 42 and outer 44 portions.

The o-ring prevents leakage from between the first 30 and second 34 valve plates through the porous material of the reed valve gasket and thus minimizes leakage of the gas being compressed by the compressor into its environment.

Figure 4:
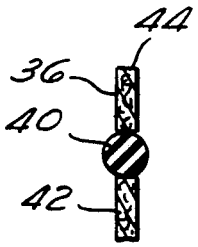
FIG. 4 is a cross-sectional side view of the o-ring of the reed valve gasket taken along lines 4 of FIG. 3, prior to compression of the o-ring.

With particular reference to FIG. 4, the o-ring 40 is illustrated in cross-section prior to disposing the reed valve gasket 36 intermediate the first 30 and second 34 valve plates. As can be seen, the o-ring 4 is not compressed and thus extends substantially beyond the edges of first 42 and second 44 portions of the reed valve gasket 36.

Figure 5:
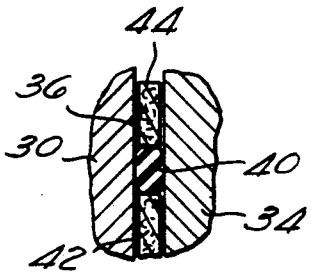
FIG. 5 is a cross-sectional side view of the o-ring of FIG. 4 having been compressed intermediate the first and second valve plates.

With particular reference to FIG. 5, the o-ring 40 is compressed intermediate the first 30 and second 34 valve plates to provide a substantially gas-tight seal and thereby prevent leakage of compressed gases through the reed valve gasket 36 into the compressor's environment.

Referring now to FIGS. 6 and 7, each piston 14 disposed within a cylinder 12 further comprises first 46 and second 48 upper rings and lower ring 50. Each ring 46, 48, and 50 comprises a bias cut 52 to minimize leakage or blow-by. Use of a bias cut 52 reduces the gap commonly found at the ends of the rings.

A port 54 formed in the cylinder 12 provides fluid communication from inside the cylinder 12 intermediate the upper rings 46 and 48 and the lower ring 50 to either the cylinder intake or an exhaust port located outside of the compressor's immediate environment, i.e., outside of the grain storage area. Thus, any blow-by being exhausted through port 54 is either reintroduced into the compressor for recompression thereof or exhausted and thus of no concern.

The port 54 is formed in the cylinder 12 such that the port 54 is disposed above the lower ring 50 when the piston 14 is positioned at top dead center and the port 54 is disposed below the upper rings 46, 48 when the piston 14 is positioned at bottom dead center.

Having described the structure of the low blow-by compressor of the present invention, it might be beneficial to describe the operation thereof. As with contemporary oilless compressors, when the motor 10 is actuated, shaft 24 rotates the eccentric bearing 22 and thus causes the connecting rod 20 to drive the piston 14 up and down.

Blow-by occurs on the upstroke as pressurized gases leak past the first 46 and second 48 upper piston rings. The use of bias cut piston rings in the present invention minimizes the amount of blow-by thus occurring.

Any gases which do leak past the first 46 and second 48 piston rings tend to be prevented from leaking from the cylinder past skirt 28 by the lower piston ring 50 which is likewise bias cut to minimize leakage. Thus, any gases which leak past the first 46 and second 48 upper piston rings are captured intermediate the upper 46, 48 and lower 50 piston rings and exit the cylinder 12 via port 54. These gases are then communicated either to the compressor inlet or the external environment such that the oxygen concentration of the storage container is not raised thereby.

During the upstroke of the piston 14, the reed valve gasket 36 is subjected to increased pressure. Gases are prevented from diffusing through the porous material of the reed valve gasket 36 by o-ring 40 which is compressed intermediate the first 30 and second 34 valve plates.

As such, blow-by and other leakage of gases from the cylinder of the oilless air compressor are minimized such that the compressor may be used inside of an environment within which it is not desirable to have the gases being compressed leak into. More particularly, the low blow-by compressor of the present invention reduces the amount of blow-by and leakage which would otherwise increase the oxygen content of a grain transport container or the like, within which it is disposed. The low blow-by compressor of the present invention is thus suitable for use in a system which provides a low oxygen-concentration atmosphere for a transport container or the like.

It is understood that the exemplary low blow-by compressor described herein and shown in the drawings represents only a presently preferred embodiment of the invention. Indeed, various modifications and additions may be made to such embodiment without departing from the spirit and scope of the invention. For example, a plurality of piston rings may be utilized at the inboard or lower periphery of the piston to better mitigate the potential for leakage of gases thereby. Also, a plurality of ports may be formed in the cylinder intermediate the upper and lower piston rings to better facilitate fluid communication of gases blown by the upper piston rings from the cylinder. Indeed, application of the present invention need not be limited to compressors. Rather, those skilled in the art will recognize that the present invention may find application in a wide variety of fluid pumps and the like. Thus, these and other modifications and additions may be obvious to those skilled in the art and may be implemented to adapt the present invention for use in a variety of different applications.

What is claimed is:

1. A low blow-by compressor, said compressor comprising:

a) a cylinder;

b) a piston disposed within said cylinder, said piston having top and bottom ends;

c) at least one first ring disposed about said piston proximate the top end thereof;

d) at least one second ring disposed about said piston proximate the bottom end thereof;

e) a port formed in said cylinder such that said port is disposed above said second rings when said piston is positioned at top dead center and said port is disposed below said first rings when said piston is positioned at bottom dead center;

f) an inlet in fluid communication with said cylinder;

g) wherein said port is in fluid communication with said inlet; and h) wherein at least a portion of any fluid which blows by said first rings exits said cylinder through said port rather than blowing by said second rings.

2. A low blow-by compressor, said compressor comprising:

a) a cylinder;

b) a piston disposed within said cylinder, said piston having top and bottom ends;

c) at least one first ring disposed about said piston proximate the top end thereof;

d) at least one second ring disposed about said piston proximate the bottom end thereof;

e) a port formed in said cylinder such that said port is disposed above said second rings when said piston is positioned at top dead center and said port is disposed below said first rings when said piston is positioned at bottom dead center;

f) an airtight container within which said compressor is disposed, said port exhausting fluid outside said container; and g) wherein at least a portion of any fluid which blows by said first rings exits said cylinder through said port rather than blowing by said second rings.

3. A seal for a low blow-by compressor, said seal comprising:

a) a gasket comprised of a porous material and configured for positioning intermediate two valve plates of the compressor;

b) an o-ring disposed generally about the periphery of said gasket; and c) wherein the o-ring mitigates fluid leakage about said gasket.

4. The seal as recited in claim 3 wherein said o-ring comprises silicon rubber.

5. The seal as recited in claim 3 further comprising a channel cut completely through said planar gasket, said o-ring being disposed at least partially within said channel.

6. The seal as recited in claim 5 wherein said o-ring is adhesively bonded to said gasket.

* * * * *